US005148796A

United States Patent [19]

Simo

[11] Patent Number: 5,148,796

[45] Date of Patent: * Sep. 22, 1992

[54] ARROW REST BEING LATERALLY ADJUSTABLE AND INSTANTLY REPLACEABLE IN A PREDETERMINED FIXED POSITION

[76] Inventor: Miroslav A. Simo, 370 N. Delaplaine Rd., Riverside, Ill. 60546

[ * ] Notice: The portion of the term of this patent subsequent to Oct. 22, 2002 has been disclaimed.

[21] Appl. No.: 693,776

[22] Filed: Apr. 26, 1991

Related U.S. Application Data

[63] Continuation of Ser. No. 418,190, Oct. 6, 1989, abandoned, which is a continuation-in-part of Ser. No. 170,161, Mar. 18, 1988, Pat. No. 4,881,515, which is a continuation-in-part of Ser. No. 57,383, Jun. 2, 1987, Pat. No. 4,809,670, which is a continuation-in-part of Ser. No. 788,486, Oct. 17, 1985, Pat. No. 4,732,135, which is a continuation-in-part of Ser. No. 482,186, Apr. 5, 1983, Pat. No. 4,548,188.

[51] Int. Cl.[5] ..... F41B 5/00

[52] U.S. Cl. ..... 124/44.5; 124/24.1

[58] Field of Search ..... 124/24.1, 44.5; 403/361, 383

[56] References Cited

U.S. PATENT DOCUMENTS

| | | | |
|---|---|---|---|
| 92,860 | 7/1869 | McKinney | 403/355 |
| 1,632,386 | 7/1927 | Walers | 403/379 |
| 2,745,689 | 5/1956 | Balint et al. | 403/361 X |
| 2,829,503 | 4/1958 | Haye | 403/379 |
| 3,094,344 | 6/1963 | Varga | 403/379 |
| 3,232,286 | 2/1966 | Guyton . | |
| 3,285,237 | 11/1966 | Wolfe . | |
| 3,292,607 | 12/1966 | Hoyt, Jr. . | |
| 3,304,796 | 2/1967 | Leege . | |
| 3,482,563 | 12/1969 | Pint . | |
| 3,504,659 | 4/1970 | Babington . | |
| 3,679,252 | 7/1972 | Howie, Jr. | 403/383 X |
| 3,757,764 | 9/1973 | Ikeya . | |
| 3,769,956 | 11/1973 | Simo . | |
| 3,828,757 | 8/1974 | Finlay . | |
| 3,871,352 | 3/1975 | Stanislawski et al. . | |
| 3,907,448 | 9/1975 | Kolibar et al. | 403/361 |
| 3,935,854 | 2/1976 | Troncosco, Jr. . | |
| 4,054,119 | 10/1977 | Hansen et al. . | |
| 4,074,674 | 2/1978 | Simo . | |
| 4,119,078 | 10/1978 | Wilson et al. . | |
| 4,170,980 | 10/1979 | Killian . | |
| 4,215,666 | 8/1980 | Carroll et al. . | |
| 4,548,188 | 10/1985 | Simo . | |
| 4,592,332 | 6/1986 | Topping . | |
| 4,732,135 | 3/1988 | Simo . | |
| 4,809,670 | 3/1989 | Simo . | |
| 4,881,515 | 11/1989 | Simo | 124/414 A |

*Primary Examiner*—Randolph A. Reese
*Assistant Examiner*—Jeffrey L. Thompson
*Attorney, Agent, or Firm*—Speckman & Pauley

[57] ABSTRACT

An arrow rest for an archery bow which is quickly and easily replaceable and laterally adjustable in the field without any need for tools. The arrow rest has an arrow support arm which pivots upon movement of the arrow shaft and fletching across it and by a resilient arm hinge automatically returns to an initial predetermined position after discharge of the arrow. The arrow rest mounts on the end of an adjusting screw which extends through a hole in the handle portion of a bow. This invention provides easy lateral adjustment and complete replacement of the arrow rest in the field, without any need for tools, while maintaing the precise position and alignment of the arrow rest. This invention also provides an arrow rest that creates very little noise when an arrow shaft and fletching move across the arrow support arm.

29 Claims, 6 Drawing Sheets

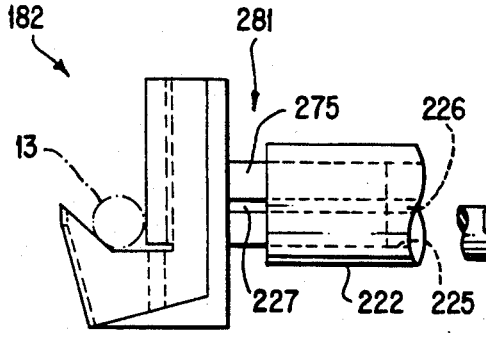
FIG. 15
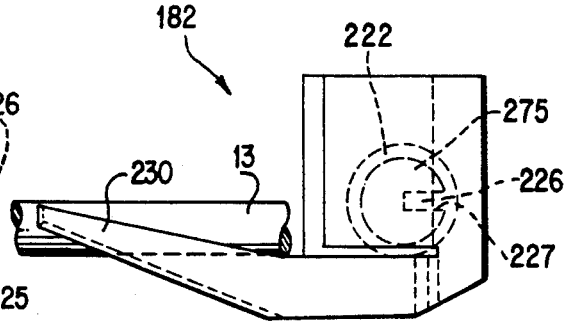
FIG. 16
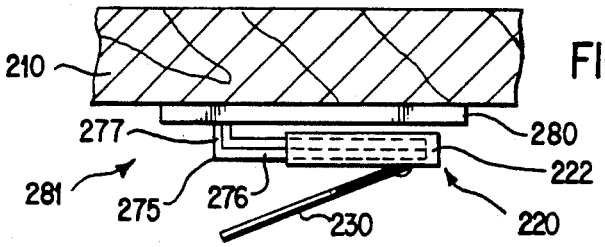
FIG. 18
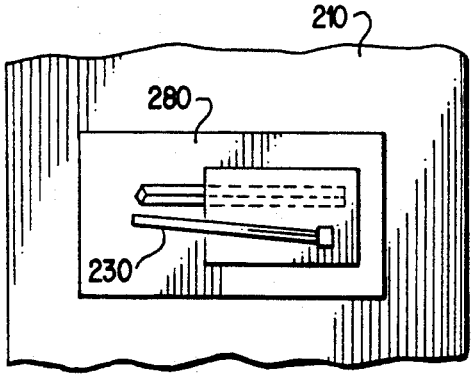
FIG. 17
FIG. 19
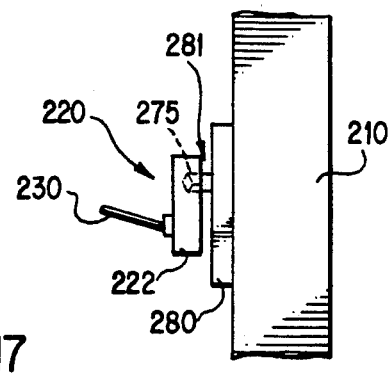
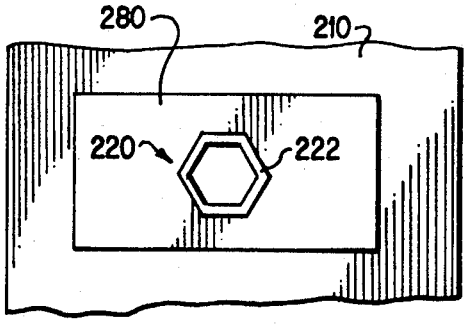
FIG. 20
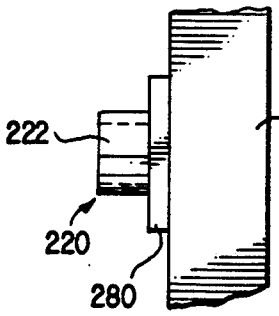
FIG. 21
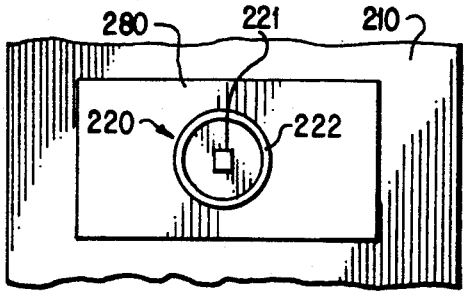
FIG. 22
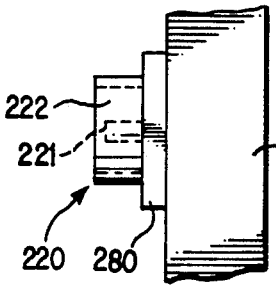
FIG. 23

ARROW REST BEING LATERALLY ADJUSTABLE AND INSTANTLY REPLACEABLE IN A PREDETERMINED FIXED POSITION

CROSS REFERENCE TO RELATED APPLICATIONS

This is a continuation of copending application Ser. No. 418,190, filed on Oct. 6, 1989, now abandoned, which is is a continuation-in-part of my earlier application, Ser. No. 170,161, filed Mar. 18, 1988, now U.S. Pat. No. 4,881,515, which is a continuation-in-part of my earlier filed application, Ser. No. 057,383, filed Jun. 2, 1987, now U.S. Pat. No. 4,809,670, which is a continuation-in-part of my earlier filed application, Ser. No. 788,486, filed Oct. 17, 1985, now U.S. Pat. No. 4,732,135, which is a continuation-in-part of my earlier filed application, Ser. No. 482,186, filed Apr. 5, 1983, now U.S. Pat. No. 4,548,188.

BACKGROUND OF THE INVENTION

1. Field of the Invention

This invention relates to an arrow rest for an archery bow, and more particularly to an arrow rest which is laterally adjustable and instantly replaceable in a consistent and predetermined fixed position. This invention provides a friction fitting between the arrow rest and mated mounting which allows the arrow rest to be instantly changed in the field, without the need for tools, while maintaining the critical position and alignment of the arrow rest.

2. Description of the Prior Art

An arrow rest is generally secured to the handle area of an archery bow, and often includes a rigid notch or ledge which supports and guides an arrow as it is discharged from the bow. However, rigid arrow rests may introduce undesirable vertical and horizontal force components to the arrow when the shaft and fletching pass over the arrow rest, causing undesired deflection of the arrow and damage to the fletching.

Flexible arrow rests which deflect both vertically and horizontally by spring action when the arrow passes over the arrow rest decrease such undesired deflection, as described in U.S. Pat. Nos. 4,074,674, 3,871,352 and 3,935,854. Spring biased arrow rests deflecting in a generally horizontal plane are described in U.S. Pat. Nos. 3,769,956 and 3,828,757. Also, arrow rests may be mechanically deflected away from the arrow when the arrow is discharged, as described in U.S. Pat. No. 3,504,659.

An arrow may travel laterally with respect to the bow if the arrow rest is not properly aligned on the handle. Prior arrow rests which may be laterally adjusted require the use of tools or are rigid rests, as described in U.S. Pat. Nos. 3,285,237, 3,871,352, 3,232,286 and 3,757,764. A spring-biased plunger for lateral placement of an arrow on a fixed rest is described in U.S. Pat. No. 3,482,563.

Prior arrow rests have been secured to the bow handle area with adhesive, screws, or the like, and when replacement of the arrow rest is necessary due to breakage or wear, there is no assurance that the new arrow rest, even if of the same style as the old arrow rest, will be properly positioned for shooting without essentially complete realignment to maintain a consistent sight and nocking point. The prior art does not suggest an arrow rest which may be easily laterally adjusted and replaced in the field, without the use of tools, and which provides a movable arrow support arm which automatically returns to its initial position after discharge of the arrow.

SUMMARY OF THE INVENTION

It is one object of this invention to provide an arrow rest that can be quickly disconnected, particularly without a need for tools, from an archery bow and then instantly replaced in a precise and consistent position with respect to the bow.

It is another object of this invention to provide an arrow rest that once set in a predetermined position does not rotate in a plane parallel to the plane of the bow handle-riser portion.

It is another object of this invention to provide an arrow rest having a first adapter secured with respect to a bow handle riser portion of an archery bow and a second adapter secured to the arrow rest, wherein the first and second adapters are non-rotatably mateable with each other.

It is another object of this invention to provide an arrow rest having an arrow support arm which may be deflected by movement of an arrow shaft and fletching of an arrow wherein the arrow support arm automatically returns to its initial position after discharge of the arrow.

Another object of this invention is to provide an arrow rest which may be quickly and easily laterally adjusted in the field without requiring tools to accomplish such lateral adjustment.

Still another object of this invention is to provide a laterally adjustable arrow rest wherein complete lateral adjustment can be achieved, that is, all the way to the bow handle-riser portion without interference from the thickness of a mounting plate or mechanical return mechanism.

Yet another object is to provide an arrow rest having a lateral depression and return "plunger" action caused by an arrow shaft upon discharge of the arrow.

Objects of this invention are accomplished by having a quick disconnection between the arrow rest and the bow handle-riser portion of an archery bow which includes first connecting means fixed with respect to the bow handle-riser portion and second connecting means secured to the arrow rest. The first connecting means are non-rotatably mateable with the second connecting means. In a mounted position of the arrow rest with respect to the bow handle-riser portion, the first connecting means are secured to the second connecting means thereby locking the arrow rest in a fixed position. The first connecting means can be repeatedly positioned and instantly replaced in a precise and consistent position with respect to the bow. It is a very important aspect of this invention to have an arrow rest that can be instantly replaced in a precise and consistent position since a 1° to 2° misalignment of the arrow rest results in an error of about 2½ to 5 feet at a target positioned 50 yards from the bow.

The first connecting means may include an adapter having one end secured to the arrow rest and an opposite end extending away from the arrow rest. In one embodiment of this invention, the adapter is an elongated sleeve or female connector. In another embodiment, the adapter is an elongated peg or male adapter.

The female adapter has an outward portion that is at an angle, preferably about 90°, with respect to an inward portion of the adapter. In another embodiment, the outward portion is approximately perpendicular to a longitudinal axis of the bow handle-riser portion. Such outward portion preferably projects in a direction of a flight path of an arrow.

In a preferred embodiment of this invention, the female adapter has a non-circular internal cross section, preferably having a polyhedral periphery or a circular periphery with at least one keeper mateable with a keyway of the opposite connecting means.

In another embodiment, the first connecting means include a peg having a non-circular cross section which is mateable within the cavity of a female adapter. In another embodiment, the second connecting means may include an elongated male adapter having one end fixed with respect to the bow handle-riser portion and an opposite end extending outward from the bow handle-riser portion. In one embodiment, the male adapter has an outward portion which is at an angle, preferably about 90°, with respect to an inward portion. In another embodiment, the outward portion is approximately perpendicular to a longitudinal axis of the bow handle. The outward portion preferably projects in an opposite direction from the flight of path of an arrow. The male adapter preferably has a non-circular external cross section, such as a polyhedral periphery or a circular periphery with a keyway.

It is apparent that the first connecting means can be either a sleeve or female adapter while the second connecting means is a mateable peg or male adapter. Likewise, the first connecting means can be either a peg or male adapter while the second connecting means is a mateable sleeve or female adapter.

In another embodiment of this invention, which relates to a lateral adjustment mechanism and arrow rest as well as the quick disconnection, an arrow rest is mounted to the first end of an adjusting screw which has a first portion fixedly attachable within a transverse hole in the bow handle-riser portion and an outer second portion sized to extend outwardly from the bow handle-riser portion on the side away from the arrow rest when fixedly attached within the hole. The first end of the adjusting screw has first connecting means. Second connecting means extend outwardly from one side of the plate portion of the arrow rest. The first and second connecting means non-rotatably mate and longitudinally seat with respect to each other. The adjusting screw provides lateral adjustment means coacting within the transverse hole in the bow handle which causes longitudinal movement of the adjusting screw and arrow rest mount with respect to the transverse hole in the bow handle. The arrow support means may be any suitable removable arrow rest such as a flat plate having a pivotal arrow support arm mounted on one side and the plate being removably attachable to the first connecting means.

An important aspect of this invention is the provision of a laterally adjustable replaceable arrow rest having a pivotal arrow support arm which is deflected out of the way by the arrow and arrow fletching and is automatically returned to its initial predetermined position after discharge of the arrow. This is achieved by an adjusting screw having means for retaining a flat plate having a pivotal arrow support arm mounted on one side. On the opposite side of the flat plate second connecting means non-rotatably and frictionally mate and seat with the first connecting means. A one-piece arrow rest is provided with an arrow support arm which may have a generally vertical pivot portion or a pivot portion at up to 45° to the vertical. The arrow support arm extends outwardly in a direction generally opposite from the second connecting means. The arrow support arm has a grooved portion forming a resilient arm hinge which positions the support arm in a predetermined position and after deflection of the support arm, caused by movement of the arrow shaft and fletching across the arrow support arm, and automatically returns the support arm to its predetermined position.

One embodiment of this invention provides a one-piece arrow rest, preferably constructed of a synthetic polymeric material, such as nylon or silicone and a low friction coating material. The one-piece arrow rest comprises a flat plate with second connecting means on one side and an arrow support arm extending from the opposite side. The arrow support arm has sufficient length to support the arrow shaft. The arrow support arm has a grooved portion forming a resilient arm hinge near the portion where the arrow support arm meets the flat plate. The grooved portion acts as a resilient arm hinge allowing the arrow support arm to displace either horizontally or both horizontally and vertically, depending on the relative direction of the grooved portion. The angle of attachment of the grooved portion forces the arrow support arm into a predetermined position. The arrow support arm will deflect due to movement of the arrow shaft and fletching over the arrow support arm and will automatically return to its initial position after discharge of the arrow.

Due to the synthetic polymeric construction material, very little noise is created as the arrow shaft and fletching moves over the arrow support arm, unlike prior arrow rests. In hunting game, it is very important to have quiet conditions for the slightest sound, such as an arrow moving over an arrow support arm, will spook an animal.

This invention provides an arrow rest with full lateral adjustment which allows the arrow rest to mount very close to the arrow side of the bow, whereby prior rests require a thickness for spring mechanisms and a mounting body which prevent full lateral adjustment adjacent to the bow surface.

In another embodiment, lateral pressure on the arrow rest, caused by a moving arrow shaft, forces inwardly a contact portion of the arrow rest. The contact portion is where the arrow shaft makes contact with the vertical face of the arrow rest. Such contact portion of the arrow rest provides a depression and return action with a grooved portion forming a resilient contact hinge similar to the arrow support arm as described in the previous embodiment. The force opposing the inward force of the arrow, applied to the contact portion can be adjusted by quickly and easily replacing one arrow rest with another that has a different strength of resilient contact hinge or construction material.

BRIEF DESCRIPTION OF THE DRAWINGS

The above mentioned and other features of this invention and the manner of obtaining them will become more apparent, and the invention itself will be best understood by reference to the following description of specific embodiments of the invention taken in conjunction with the accompanying drawings, in which:

FIG. 15 is a rear view of an arrow rest having second connecting means according to another embodiment of this invention;

FIG. 16 is a side view of the arrow rest as shown in FIG. 15;

FIG. 17 is a front view of first connecting means according to one embodiment of this invention;

FIG. 18 is a top view of the first connecting means as shown in FIG. 17;

FIG. 19 is a side view of the first connecting means as shown in FIG. 17;

FIG. 20 is a front view of first connecting means according to another embodiment of this invention;

FIG. 21 is a side view of the first connecting means as shown in FIG. 20;

FIG. 22 is a front view of first connecting means according to another embodiment of this invention;

FIG. 23 is a side view of the first connecting means as shown in FIG. 22;

DESCRIPTION OF THE PREFERRED EMBODIMENTS

Figure 1:
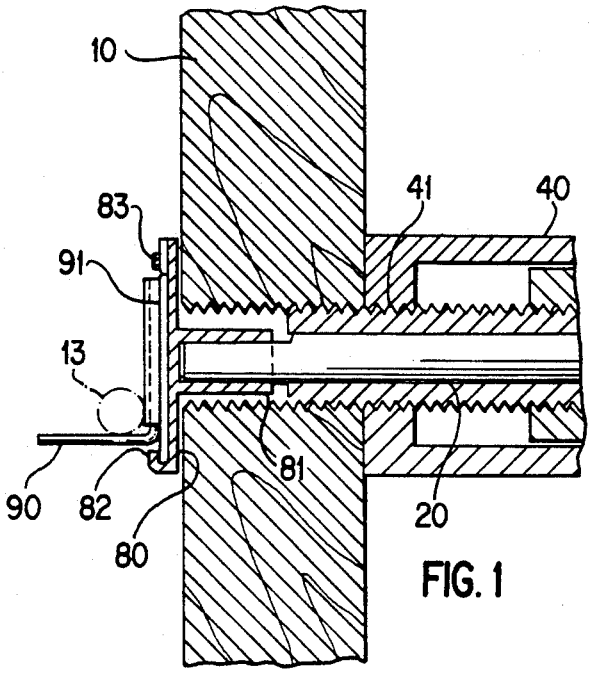
FIG. 1 is a partial cross-sectional view showing one embodiment of a mounted arrow rest according to this invention.

U.S. Pat. Nos. 4,548,188, 4,732,135 and 4,809,670 more fully teach embodiments of the invention shown in FIGS. 1 through 5. These patents in their entirety are incorporated herein by reference. In these embodiments, the arrow support means may have a conventional retractable arrow support wire 90 mounted on flat plate 91, many of such suitable arrow rests being well known to the art and previously adhered or otherwise fastened to the side of a bow. These patents teach that flat plate 91 of the arrow rest is removably, rigidly attached to one side of mating mounting plate 80, the other side of mating mounting plate 80 having tubular fitting means 81 snugly fitting over the end of mounting means 20 and may be maintained firmly in position by a screw into the end of mounting means 20. It is apparent that tubular fitting means 81 can have a "D" cross-sectional shape, as shown in FIG. 2, a double "D" cross-sectional shape as shown in FIG. 2*a* or any other cross-sectional shape that prevents rotation of mounting plate 80 with respect to handle-riser portion 10.

Figure 2:
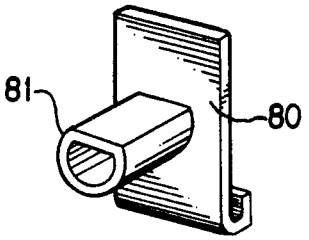
FIG. 2 is a perspective rear view of the fitting means shown in FIG. 1.
Figure 2A:
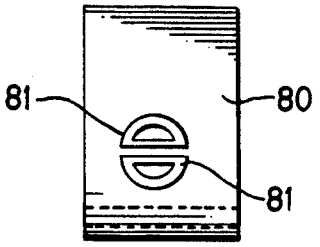
FIG. 2*a* is a rear view of another embodiment of the fitting means.
Figure 3:
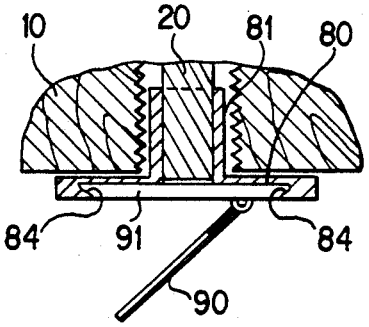
FIG. 3 is a top cross-sectional view of another embodiment of an arrow rest according to this invention.
Figure 4:
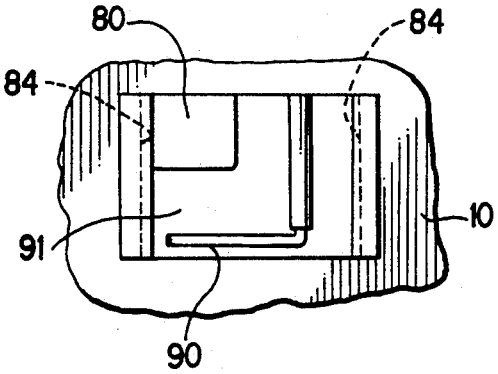
FIG. 4 is a front view of the arrow rest shown in FIG. 3.

These patents teach a suitable mating mounting plate as shown in FIGS. 1 and 2 wherein mounting plate 80 has lip holding means 82 along the bottom edge and undercut holding means 83 extending through elongated holes in flat plate 91 to hold the retractable arrow rest flat plate 91 firmly in position. Thus, the retractable arrow rest may be readily replaced and assuredly positioned in the same position on mating mounting plate 80. Any suitable means for holding the retractable arrow rest to mounting plate 80 may be used. Another means of holding retractable arrow rest flat plate 91 is shown in FIGS. 3 and 4 wherein opposing sides have undercut edges 84 which mate with opposing sides of flat plate 91. Having a removable flat plate 91 as well as the connection between fitting means 81 and mounting means 20 provides an arrow rest having double instantly replaceable capabilities so that the arrow rest can be replaced either way or both ways.

Figure 5:
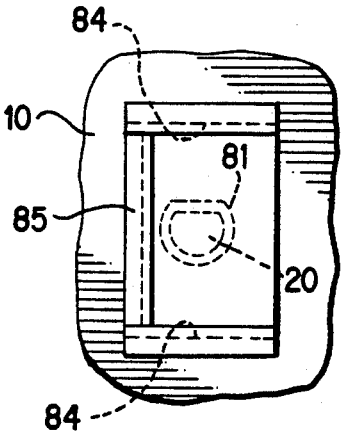
FIG. 5 is a front view of another embodiment of fitting means according to this invention.

In a similar fashion as shown in FIG. 5, the retractable arrow rest may be slid sideways into mating mounting plate having undercut top and bottom edges 84 and front stop 85. As shown in FIG. 5, tubular fitting means 81 is hollow and abuts mounting plate 80 which closes the abutting end of tubular fitting means 81. It is apparent that mounting plate 80 can also have a hole where tubular fitting means 81 abuts so that a stub protruding from the end of mounting means 20 could be adapted or mated to provide additional strength and rigidity to mounting plate 80.

Figure 6:
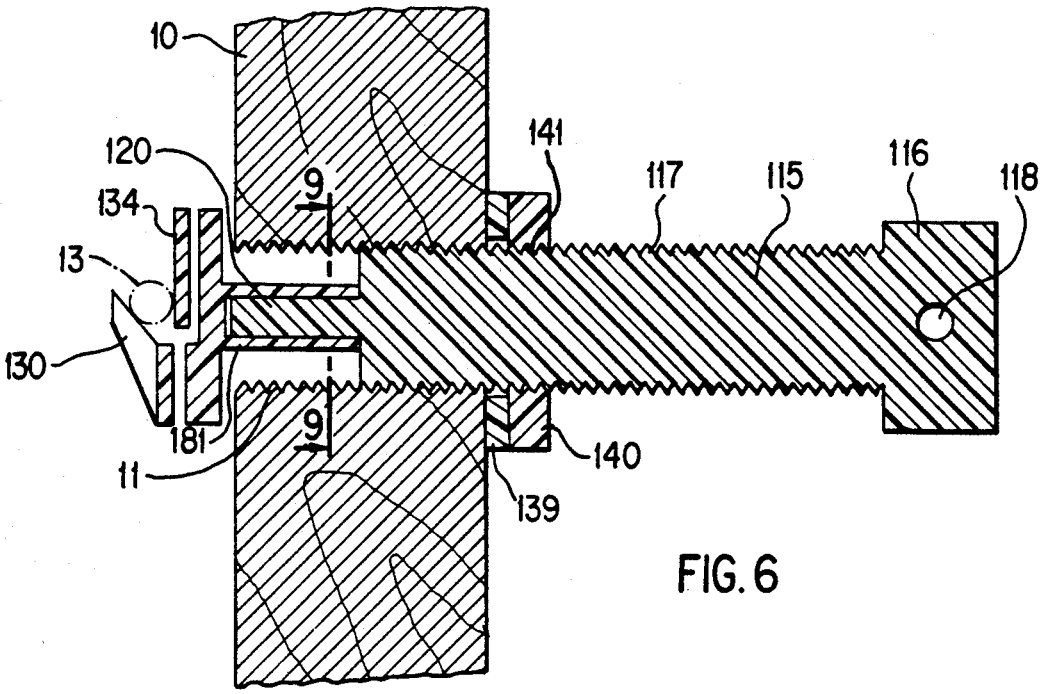
FIG. 6 is a cross-sectional view through a bow handle from the side of the archer showing one embodiment of a mounted arrow rest of this invention.

FIG. 6 shows one embodiment of a laterally adjustable one-piece arrow rest, having a movable arrow support arm 130 which deflects and automatically returns to an initial predetermined position. Adjusting screw 115 is installed in through opening 11 in handle-riser portion 10 of an archery bow. Adjusting screw 115 is secured and maintained in fixed relation to the bow by adjusting screw external threads 117 engaging internal threads of through opening 11. Adjusting screw 115 can be inserted into through opening 11 from either the arrow side or side opposite the arrow side of bow handle-riser portion 10. Adjusting screw 115 may be firmly held in a fixed lateral position by washer 139 and lock nut 140. Lock nut 140 can have internal threads 141 which engage adjusting screw external threads 117 and can be screwed tightly against one side of washer 139. The opposite side of washer 139 can be adjacent either side of bow handle-riser portion 10 of an archery bow.

Adjusting screw 115 has adjusting screw end 116 positioned away from bow handle-riser portion 10. Adjusting screw end 116 can have an outside diameter greater than the outside diameter of adjusting screw 115. However, adjusting screw 115 has the capability of being inserted from either side of bow handle-riser portion 10 only if adjusting screw end 116 has an outside diameter less than or equal to the inside diameter of the internal threads of through opening 11. Adjusting screw end 116 has diametrical through hole 118. A rod inserted in through hole 118 serves at least two purposes. First, the rod can be used as a lever arm to torque adjusting screw 115 into through opening 11. Second, through hole 118 aligns with first connecting means 120 such that the through hole 118 or the rod inserted in through hole 118 can be used as an index for the alignment of first connecting means 120.

Rotation of adjustment screw 115 causes lateral movement of adjusting screw 115. The exterior of lock nut 140 may have flats for engagement of a wrench or may have knurls and a diameter sufficient for hand tightening, preferably knurls for quick assembly and disassembly in the field, without any need for tools. When lock nut 140 is screwed tightly against washer 139 and washer 139 against bow handle-riser portion 10, both adjusting screw 115 and lock nut 140 are firmly attached in a fixed position with respect to the bow. It is preferred that threads 117 of adjustment screw 115 extend approximately halfway through the thickness of bow handle-riser portion 10 to provide sufficient support for adjustment screw 115 and sufficient longitudinal bearing surface between first connecting means 120 and second connecting means 181.

Figure 9:
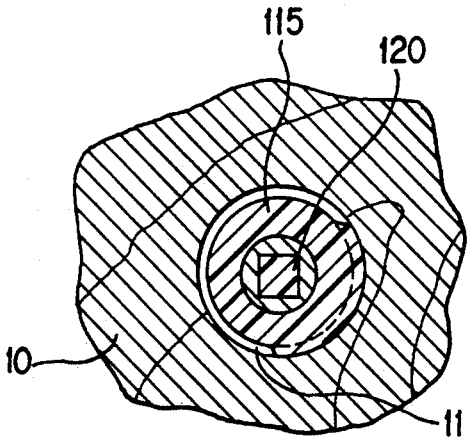
FIG. 9 is a cross-sectional view along line 9—9 in FIG. 6 showing one embodiment of first connecting means and second connecting means.

In one embodiment of this invention, second connecting means 181 has an elongated shape and has a sleeve adapted to fit non-rotatably but longitudinally movable and seat with first connecting means 120 of adjusting screw 115. The term "seat" or "seated", as used throughout this specification and in the claims, is intended to mean that the seated component is fixed in a particular position, with respect to another component. First connecting means 120 may have any suitable cross-sectional shape to non-rotatably mate with second connecting means 181. Various cross-sectional shapes for first connecting means 120 and mating second connecting means 181 may be used. A first connecting means 120 according to this embodiment is shown more clearly in the cross-sectional view of FIG. 9. The non-circular cross-sectional shape of first connecting means 120 provides a non-rotatable and longitudinally movable fit and seat within second connecting means 181. First connecting means 120 may have other cross sections such as a truncated circular cross section or a splined shape cross section. It is readily apparent that other non-circular cross-sectional shapes would also be suitable.

In addition to first connecting means 120 being adjustable longitudinally with respect to bow handle-riser portion 10, pressure from the arrow shaft applied laterally to arrow rest 182 may force arrow contact portion 134 inwardly thereby causing longitudinal movement of contact portion 134 by a resilient contact hinge which returns to its original predetermined position when the force of the arrow shaft is removed. The resilient contact hinge is formed by a section of contact portion 134 having a reduced moment of inertia, with respect to the moment of inertia of adjacent sections of contact portion 134, in order to reduce the bending resistance of contact portion 134. The grooved portion of the resilient hinge reduces the force necessary to deflect the cantilever portion of contact portion 134. The force necessary to move contact portion 134 can be adjusted by quickly and easily replacing one arrow rest 182 with another arrow rest 182 having a different grooved portion forming a resilient contact hinge or different construction material.

This invention includes first connecting means 120 which are non-rotatably mated and seated with respect to second connecting means 181. In this particular embodiment, the term "seated" is intended to mean that first connecting means 120 is fixed in a mated position with second connecting means 181. The end, facing away from the arrow shaft, of second connecting means 181 can seat against the shoulder created where the base of first connecting means 120 meets adjusting screw 115. Second connecting means 181 can also seat with respect to first connecting means 120 if the end face of first connecting means 120 contacts the plate portion of second connecting means 181, or the seating can occur if the plate portion of second connecting means 181 contacts bow handle-riser portion 10. Even if first connecting means 120 does not seat on second connecting means 181, an interference fit with friction and compression between both connecting means will hold arrow rest 182 in a fixed position with respect to first connecting means 120.

Figure 10:
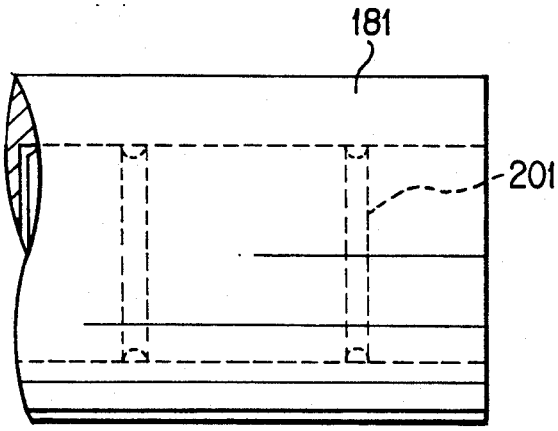
FIG. 10 is a front view of second connecting means according to one embodiment of this invention.
Figure 11:
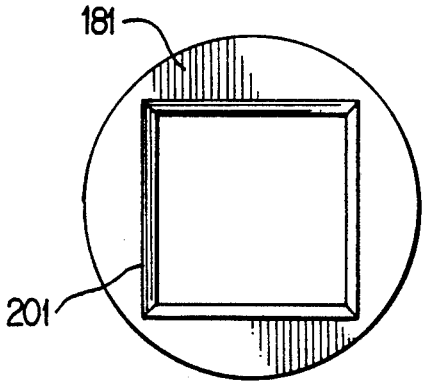
FIG. 11 is a side view of second connecting means as shown in FIG. 10.
Figure 14:
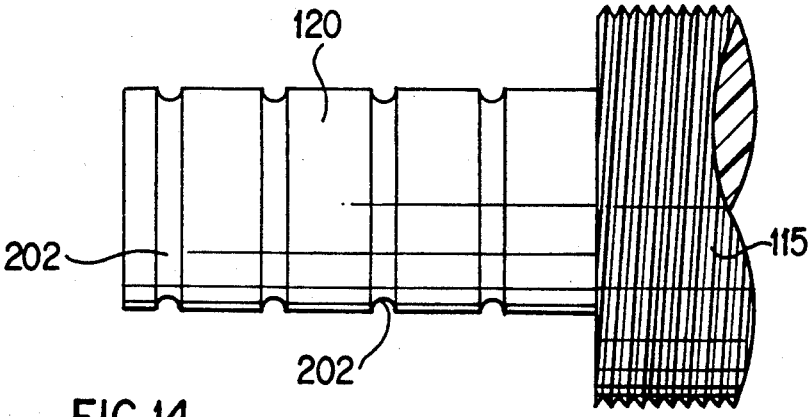
FIG. 14 is a front view of first connecting means according to one embodiment of this invention.

In another embodiment of this invention as shown in FIG. 14, first connecting means 120 has at least one peripheral groove 202 located on the outside surface of first connecting means 120. As shown in FIGS. 10 and 11, second connecting means 181 has at least one peripheral rib 201 located on the inside surface of second connecting means 181. Peripheral rib 201 on second connecting means 181 mates with peripheral groove 202 in first connecting means 120, in a locking manner.

With such locking peripheral rib 201 and peripheral groove 202, first connecting means 120 and second connecting means 181 can longitudinally move and seat with respect to each other. Although one peripheral groove 202 and one peripheral rib 201 will accomplish such purpose, the preferred embodiment of this invention has several peripheral grooves 202 and peripheral ribs 201 spaced to provide more precise lateral adjustments. It is apparent that peripheral ribs 201 can protrude from the surface of first connecting means 120 and second connecting means 181 can have peripheral grooves 202 on the inner sleeve wall of first connecting means 120.

Figure 12:
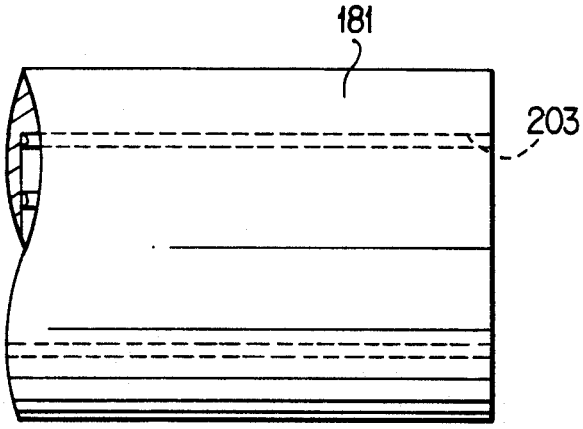
FIG. 12 is a front view of second connecting means according to another embodiment of this invention.
Figure 13:
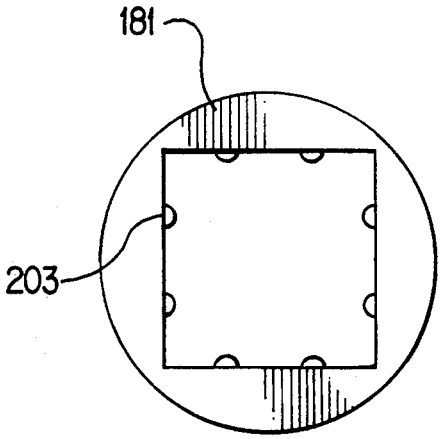
FIG. 13 is a side view of second connecting means as shown in FIG. 12.

First connecting means 120 can have any cross-sectional shape, preferably square or polygonal, that prevents first connecting means 120 from rotating with respect to second connecting means 181. According to one embodiment of this invention, FIGS. 12 and 13 show a plurality of longitudinal crush ribs 203 located on the inner sleeve wall of second connecting means 181. Longitudinal crush ribs 203 compress and frictionally seat, with an interference fit, first connecting means 120 with respect to second connecting means 181. First connecting means 120 preferably has rounded-off corners at the end of its pin portion thereby allowing first connecting means 120 to be easily inserted into second connecting means 181 without creating burrs. Likewise, it is apparent that longitudinal crush ribs 203 can protrude from the surface of first connecting means rib 120.

Although one preferred embodiment of this invention has two mating pieces with first connecting means 120 having the male fitting and second connecting means 181 having the female fitting, it is apparent that another embodiment of this invention may have first connecting means 120 as the female fitting and second connecting means 181 as the male fitting.

Prior arrow rests secure to bow handle-riser portion 10 with adhesives, screws, or the like, which require complete realignment once removed. In addition, except for the stick-on type, which uses double-sided tape, prior arrow rests require tools for assembly and disassembly. The non-rotatable and seating connection of this invention provides quick and easy field assembly and disassembly without any need for tools while maintaining the precise position and alignment of the arrow rest.

Figure 7:
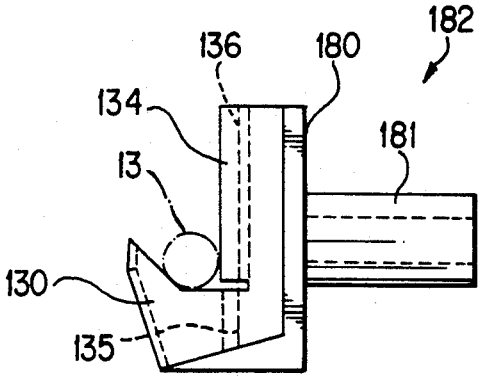
FIG. 7 is a rear view of the arrow rest as shown in FIG. 6.
Figure 8:
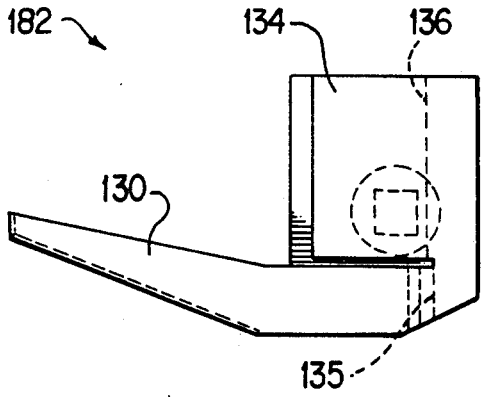
FIG. 8 is a side view of the arrow rest as shown in FIG. 6.

One important embodiment of this invention includes a pivotal arrow support arm 130 as an integral one-piece part of arrow rest 182 whereby arrow support arm 130 deflects upon an arrow shaft and fletching passing over arrow support arm 130. A grooved portion forming resilient arm hinge 135 near the base of arrow support arm 130 causes automatic return of arrow support arm 130 to its initial predetermined position after discharge of an arrow. One embodiment of arrow rest 182 is shown in FIG. 7 and FIG. 8 with arrow support arm 130 in its initial predetermined position. Arrow support arm 130 extends beyond the side of the bow handle-riser portion 10 and receives arrow shaft 13.

When the force of the arrow passing over arrow support arm 130 is terminated, the grooved portion forming resilient arm hinge 135 at the base of arrow support arm 130 creates a force sufficient to return arrow support arm 130 to its original predetermined position. The resilient arm hinge is formed by a section of arrow support arm 130 having a reduced moment of inertia, with respect to the moment of inertia of adjacent sections of arrow support arm 130, in order to reduce the bending resistance of arrow support arm 130. The grooved portion of the resilient hinge reduces the force necessary to deflect the cantilever portion of arrow support arm 130. Likewise, the lateral force of the arrow shaft causes contact portion 134 to move laterally toward the bow and when the force of the arrow passing over contact portion 134 is terminated, the grooved portion forming resilient contact hinge 136 near the base of contact portion 134 creates a force sufficient to return contact portion 134 to its original predetermined position. The force, within the resilient hinges, opposing the force created by the moving arrow shaft may be controlled by varying the grooved portion or by varying the construction material used for arrow rest 182. The top of arrow support arm 130 and contact portion 134 may be covered with a low friction material that reduces the frictional drag between arrow shaft 13 and support arm 130. Suitable materials include low friction plastics, such as fluorinated hydrocarbons, such as TEFLON TM, or any other low friction materials known to the art.

This invention provides an improved arrow rest as shown in FIGS. 6, 7, 8 and 9 where arrow support arm 130, contact portion 134, mounting plate 182 and second connecting means 181 are formed from one piece. Second connecting means 181 and first connecting means 120 having an interference fit can be quickly and easily assembled, disassembled, and reassembled without any need for tools. The non-rotatable and seated mating of second connecting means 181 with first connecting means 120 allows arrow rest 280 to be precisely positioned and aligned with respect to bow handle-riser portion 10. Adjusting screw 115 and holding nut 140 allow lateral positioning and securing of arrow rest 182 with respect to bow handle-riser portion 10.

The components of the arrow rest of this invention may be constructed of suitable materials which are durable and resist weather. Suitable metals and moldable plastics will be readily apparent to one skilled in the art.

FIGS. 15–23 illustrate and focus upon quick disconnect means which are used to fix the arrow rest in a precise position with respect to the bow. The quick disconnect means is the important aspect of this invention which allows the arrow rest to be dismounted then instantly replaced in a precise and consistent predetermined position. The quick disconnect means includes first connecting means fixed with respect to handle-riser portion 210 of an archery bow and second connecting means secured to the arrow rest. FIG. 15 shows a gap between arrow rest 182 and the end of female adapter 222 but it is apparent that such gap can be either enlarged, reduced or eliminated.

Figure 18A:
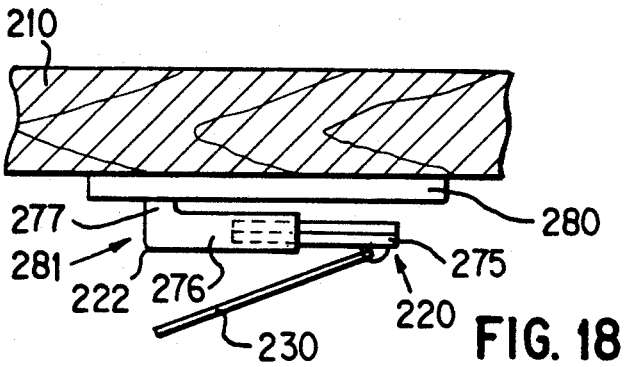
FIG. 18*a* is a top view of the first connecting means as shown in FIG. 17*a;*
Figure 17A:
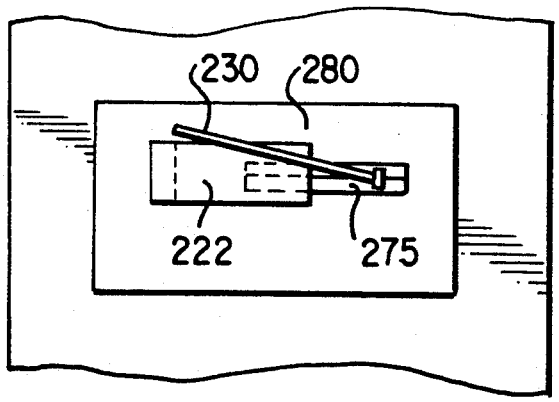
FIG. 17*a* is a front view of first connecting means according to another embodiment of this invention.
Figure 19A:
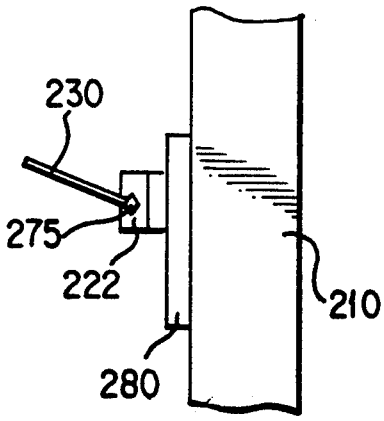
FIG. 19*a* is a side view of the first connecting means as shown in FIG. 17*a;*

In one embodiment of this invention, similar to that described above, first connecting means 220 includes a non-circular cross-sectional shape extending outward with respect to bow handle-riser portion 210. It is apparent that first connecting means 220 can be mounted directly to bow handle-riser portion 210, can be mounted on mounting plate 280 which is mounted to bow handle-riser portion 210 by any suitable means know to the art, or can be mounted to the end of adjustment screw 115, as shown in FIG. 6. In another preferred embodiment according to this invention, first connecting means includes elongated female adapter 222 having one end secured to an arrow rest, preferably an arrow rest similar to arrow rest 182 as shown in FIGS. 7 and 8, and an opposite end extending away from the arrow rest. It is apparent that the arrow rest can also comprise any other suitable arrow rest, such as an arrow rest having a wire-shaped arrow support arm 230, as shown in FIGS. 17–19. It is also apparent that the arrow rest can be replaced with another suitable archery component, such as an archery bow sight or the like.

In another embodiment according to this invention, as shown in FIGS. 17–19, male adapter 275 has an outward portion which is at an angle with respect to an inward portion of male adapter 275. The outward portion of male adapter 275 can be at any suitable angle, with respect to the inward portion, which allows second connecting means 281 to non-rotatably mate with female adapter 222. Such angle is approximately 90°. In another embodiment, the outward portion of male adapter 275 is approximately perpendicular to a longitudinal axis of bow handle-riser portion 210. Preferably, the outward portion of male adapter 275 projects in a direction of a flight path of an arrow and mates with second connecting means 281 which projects in a direction opposite of the flight path of the arrow.

In another preferred embodiment, female adapter 222 has a non-circular internal cross section. The non-circular internal cross section can have a polygonal periphery. The non-circular internal cross section may also include a circular periphery with at least one keeper 226 mateable with keyway 227 of second connecting means 281 as shown in FIGS. 15 and 16.

As shown in FIGS. 15 and 16, second connecting means 281 includes male adapter 275 which has a non-circular cross section. Male adapter 275 is mounted within cavity 225 of female adapter 222, as shown in FIG. 15. In another embodiment, first connecting means 220 includes elongated male adapter 275 with one end fixed with respect to the arrow rest and an opposite end extending outward from the arrow rest.

In another preferred embodiment of this invention as shown in FIGS. 17–19, male adapter 275 has outward portion 276 which is at an angle with respect to inward portion 277 of male adapter 275. Such angle is preferably approximately 90°, as shown in FIG. 18. In another embodiment, outward portion 276 is approximately perpendicular to a longitudinal axis of bow handle-riser portion 210. If male adapter 275 is secured with respect to bow handle-riser portion 210, outward portion 276 preferably projects in an opposite direction to the flight path of the arrow.

Figure 24:
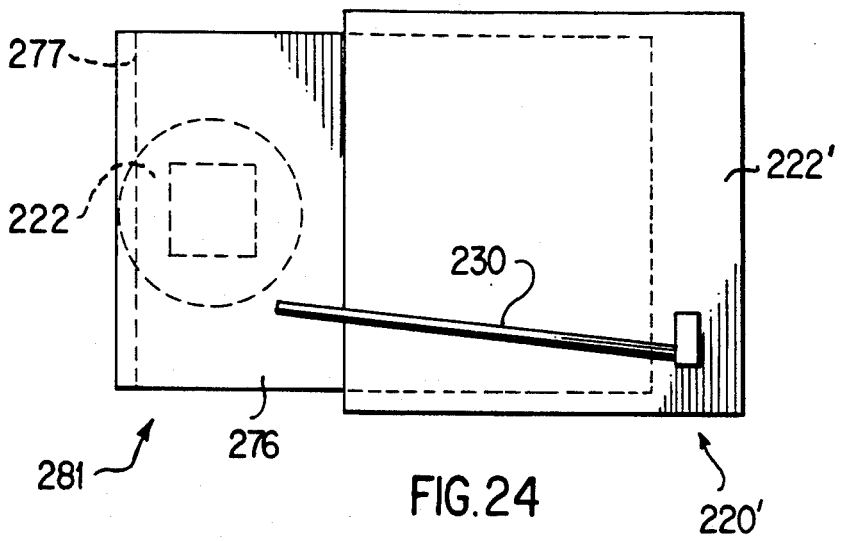
FIG. 24 is a front view of first connecting means according to another embodiment of this invention.
Figure 25:
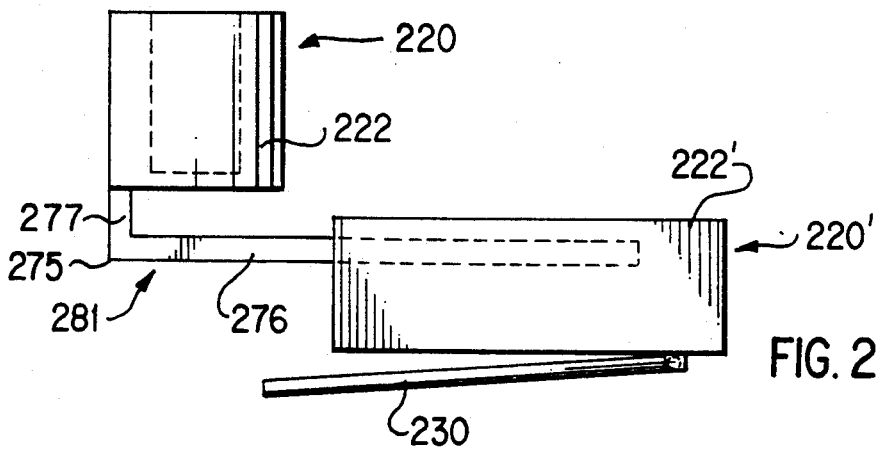
FIG. 25 is a top view of the first connecting means as shown in FIG. 24.
Figure 26:
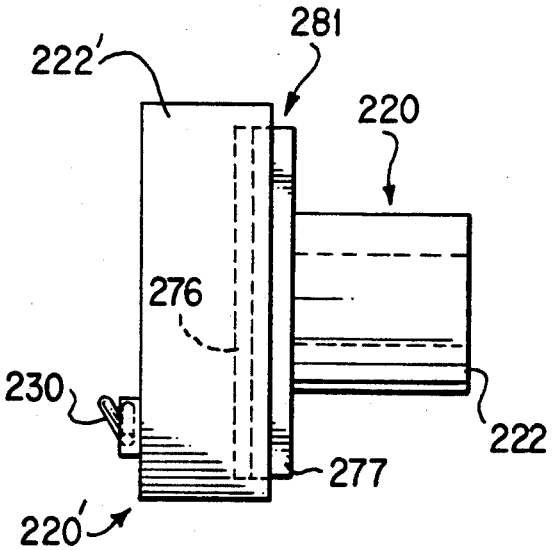
FIG. 26 is a side view of the first connecting means as shown in FIG. 24.

Male adapter 275 preferably has a non-circular external cross section. Male adapter 275 can have an overall elongated shape or a rod or bar shape, as shown in FIGS. 17–19. It is also apparent that male adapter 275 can have an overall flat plate type shape, as shown in FIGS. 24–26, or any other suitable shape that prevents rotation. For example, the non-circular external cross section can have a polygonal periphery. The non-circular cross section may also include a circular cross section with keyway 227 which is mateable with keeper 226, as shown in FIG. 16. In a mounted position of the arrow rest with respect to bow handle-riser portion 210, first connecting means 220 is secured to second connecting means 281 thereby locking the arrow rest in a fixed and non-rotatable position. First connecting means 220 mounts with respect to second connecting means 281 providing positioning means for repeatedly and instantly replacing the arrow rest in a precisely consistent position with respect to bow handle-riser portion 210.

In another preferred embodiment according to this invention, first connecting means 220 is horizontally displaceable in a direction perpendicular to a longitudinal axis of bow handle-riser portion 210 of an archery bow. It is possible for first connecting means 220 to have such horizontal displacement capability if, for example, first connecting means 220 is connected to or a part of a laterally adjustable arrow rest, such as described in U.S. Pat. No. 4,548,188 or U.S. Pat. No. 4,732,135, or another conventional laterally adjustable or plunger-type arrow rest. In yet another preferred embodiment according to this invention, the arrow rest is rotationally displaceable about an axis that is perpendicular to a longitudinal axis of bow handle-riser portion 210 of the archery bow. As shown in FIG. 16, such rotational displacement will cause the arrow rest to rotate in a counterclockwise direction thus causing arrow support arm 230 to rotate downward or counterclockwise, as shown in FIG. 16, and away from arrow 13 upon discharge of arrow 13. The forward discharge direction of arrow 13 is shown by the indicator arrow in FIG. 16. Such rotational displacement can be accomplished by connecting either first connecting means 220 or second connecting means 281 to spring means for allowing rotational displacement of arrow support arm 230, preferably limited rotational displacement, so that arrow support arm 230 can rotate downward. The tension of the spring means can also be adjusted depending upon the desired longitudinal biased movement or "cushion" effect of the arrow rest and thus arrow support arm 230, for example, in a fashion as taught by U.S. Pat. No. 4,548,188.

It is apparent that in certain embodiments of this invention, first connecting means 220 may comprise female adapter 222 as described above, or in other embodiments connecting means 220 may comprise male adapter 275 as described above for second connecting means 281. Similarly, second connecting means 281 may comprise male adapter 275 as described above, or second connecting means may comprise female adapter 222 as described above for first connecting means 220. First connecting means 220 and second connecting means 281 can be interchanged while still accomplishing the objects of this invention.

FIGS. 20–23 show different embodiments of female adapter 222 which mate with a suitably and correspondingly shaped male adapter 275, which is not shown in FIGS. 20–23. FIGS. 20 and 21 show a polyhedral configuration of female adapter 222. FIGS. 22 and 23 show another configuration where the non-rotatable configuration is formed by peg 221 mounted within a circular section of female adapter 222. It is apparent that other suitable non-circular shapes can be used to accomplish the same objectives.

FIGS. 24–26 show yet another embodiment of an arrow rest assembly, according to this invention, having double replacement features wherein the arrow rest assembly can be disconnected using either of two different instantly replaceable connections between first connecting means 220, 220' and second connecting means 281. Outward portion 276 is secured to a first connecting means 220. It is apparent that first connecting means 220 can be either female adapter 222 as shown in FIG. 25, or first connecting means 220 can be male adapter 275 and thus second connecting means 281 can be the corresponding and mating adapter, male adapter 275 or female adapter 222, respectively. In the embodiment shown in FIGS. 24–26, another second connecting means 281 comprises outward portion 276 that has an overall plate shape and mates within female adapter 222'. Arrow support arm 230 is attached to female adapter 222' in a manner similar to those previously described in this application or otherwise as known in the art. One advantage of this particular embodiment is that the all plate shape of outward portion 276 acts as a cushion for suppressing horizontal forces against the arrow rest as the arrow shaft is discharged. The cushion aspect or bias force of the plate or outward portion 276 is a function of the plate thickness. With outward portion 276 attached to first connecting means 220, as shown in FIG. 24, outward portion 276 acts as a cantilever.

It is apparent that the many elements of each of FIGS. 1–23 as described above can be interchanged to enhance the versatility of this invention. The many embodiments shown in the drawings and described in this specification require mating connections between male and female elements as well as other elements shown in the drawings and described in the specification as having a particular shape. It is also apparent that male and female roles of each element can be interchanged in such embodiments and mirror images or mirror configurations of such other elements can be used to accomplish objectives of this invention without departing from the result of obtaining an instantly replaceable arrow rest.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In an arrow rest fixedly mounted with respect to an archery bow, the arrow rest having quick disconnect means comprising:

an elongated female adapter having one end secured to the arrow rest and an opposite end extending away from the arrow rest;

an elongated male adapter having one end fixable in a non-rotatable position with respect to a bow handle of the archery bow and an opposite end extending outward from said bow handle; and said female adapter having an internal bore with a non-circular internal cross section, said male adapter having a non-circular external cross section compatible for mating with said female adapter, in a mated position said female adapter being non-rotatable with respect to said male adapter, and said male adapter forming an interference fit with said female adapter for repeatedly and instantly replacing the arrow rest in a precisely consistent and fixed position with respect to the archery bow.

2. In an arrow rest according to claim 1 wherein said elongated female adapter has an outward portion and an inward portion, and said outward portion is at an angle with respect to said inward portion.

3. In an arrow rest according to claim 2 wherein said elongated female adapter forms a cantilever and said outward portion has a free end.

4. In an arrow rest according to claim 2 wherein said angle is about 90°.

5. In an arrow rest according to claim 2 wherein said outward portion is approximately perpendicular to a longitudinal axis of said bow handle.

6. In an arrow rest according to claim 5 wherein said outward portion projects in a direction toward a tip end of an arrow mounted on the arrow rest.

7. In an arrow rest according to claim 1 wherein said non-circular internal cross section has a polygonal periphery.

8. In an arrow rest according to claim 1 wherein said non-circular internal cross section further comprises a circular periphery with at least one keeper mateable with a keyway of male adapter.

9. In an arrow rest according to claim 1 wherein said elongated male adapter has an outward portion and an inward portion, and said outward portion is at an angle with respect to said inward portion.

10. In an arrow rest according to claim 9 wherein said angle is about 90°.

11. In an arrow rest according to claim 9 wherein said outward portion is approximately perpendicular to a longitudinal axis of said bow handle.

12. In an arrow rest according to claim 11 wherein said outward portion projects in an opposite direction of a tip end of an arrow mounted on the arrow rest.

13. In an arrow rest according to claim 1 wherein said non-circular external cross section has a polygonal periphery.

14. In an arrow rest according to claim 1 wherein said non-circular external cross section is formed by a cylinder having a keyway.

15. In an arrow rest fixedly mounted with respect to an archery bow, the arrow rest having quick disconnect means comprising:

an elongated female adapter having one end fixed in a non-rotatable position with respect to a bow handle and an opposite open end extending outward from said bow handle;

an elongated male adapter having one end secured to the arrow rest and an opposite end extending away from the arrow rest;

said female adapter having an internal bore with a non-circular internal cross section, said male adapter having a non-circular external cross section compatible for mating with said female adapter, in a mated position said female adapter being non-rotatable with respect to said male adapter, and said male adapter forming an interference fit with said female adapter for repeatedly and instantly replacing the arrow rest in a precisely consistent and fixed position with respect to the archery bow.

16. In an arrow rest according to claim 15 wherein said elongated female adapter has an outward portion and an inward portion, and said outward portion is at an angle with respect to said inward portion.

17. In an arrow rest according to claim 16 wherein said angle is about 90°.

18. In an arrow rest according to claim 16 wherein said outward portion is approximately perpendicular to a longitudinal axis of said bow handle.

19. In an arrow rest according to claim 18 wherein said outward portion projects in a direction toward a tip end of an arrow mounted on the arrow rest.

20. In an arrow rest according to claim 15 wherein said non-circular internal cross section has a polygonal periphery.

21. In an arrow rest according to claim 15 wherein said non-circular internal cross section further comprises a circular periphery with at least one keeper mateable with a keyway of said male adapter.

22. In an arrow rest according to claim 16 wherein said elongated male adapter forms a cantilever and said opposite end of said male adapter is a free end.

23. In an arrow rest according to claim 15 wherein said elongated male adapter has an outward portion and an inward portion, and said outward portion is at an angle with respect to said inward portion.

24. In an arrow rest according to claim 23 wherein said elongated male adapter forms a cantilever and said outward portion has a free end.

25. In an arrow rest according to claim 23 wherein said angle is about 90°.

26. In an arrow rest according to claim 23 wherein said outward portion is approximately perpendicular to a longitudinal axis of said bow handle.

27. In an arrow rest according to claim 26 wherein said outward portion projects in an opposite direction of a tip end of an arrow mounted on the arrow rest.

28. In an arrow rest according to claim 15 wherein said non-circular external cross section has a polygonal periphery.

29. In an arrow rest according to claim 28 wherein said non-circular external cross section is formed by a cylinder having a keyway.

* * * * *